United States Patent [19]

Torti

[11] Patent Number: 4,863,331

[45] Date of Patent: Sep. 5, 1989

[54] METHOD OF MAKING HALF-BINDING HARD COVERS FOR BOOKS AND A MACHINE FOR THE IMPLEMENTATION THEREOF

[75] Inventor: Alessandro Torti, Cologno Monzese, Italy

[73] Assignee: Torriani & C. S. p.A, Cologno Monzese, Italy

[21] Appl. No.: 35,680

[22] Filed: Apr. 7, 1987

[30] Foreign Application Priority Data

Apr. 8, 1986 [IT] Italy ..... 20008 A/86

[51] Int. Cl.[4] ..... B42C 7/00

[52] U.S. Cl. ..... 412/3; 412/17

[58] Field of Search ..... 412/3, 17

[56] References Cited

U.S. PATENT DOCUMENTS

| | | | |
|---|---|---|---|
| 3,204,986 | 9/1965 | Tooker | 412/3 X |
| 3,237,223 | 3/1966 | Taylor | 412/17 |
| 4,336,094 | 6/1982 | Mills | 412/3 X |
| 4,374,441 | 2/1983 | Carter et al. | 412/3 |
| 4,405,156 | 9/1983 | Carter et al. | 412/3 X |

OTHER PUBLICATIONS

Lehrbuch der Industriellen Buchbinderei Technologie der Bucheinbande und Broschuren.

Kolbus Automatic Casemaker DA/DAS (Brochure)

Deckenmach-Maschine DM 300, der Vollautomat mit gesteigerter Produktivitat.

*Primary Examiner*—Paul A. Bell

*Attorney, Agent, or Firm*—Browning, Bushman, Zamecki & Anderson

[57] ABSTRACT

In order to form a hard book binding having a middle covering and two side coverings, a unitary covering is first formed by securing the side coverings onto the middle covering; thereafter, a spine member and two coverboard members are attached, in mutually spaced apart relationship, to said unitary covering at the middle covering and the side coverings, respectively.

9 Claims, 6 Drawing Sheets

METHOD OF MAKING HALF-BINDING HARD COVERS FOR BOOKS AND A MACHINE FOR THE IMPLEMENTATION THEREOF

BACKGROUND OF THE INVENTION

This invention relates to a method of making a hard book cover of a type which comprises two cover board members and a spine member or spine strip held together by a middle covering, and two more coverings (e.g. a hide, plastics, or paper sheet and the like) for said cover board and spine members.

Throughout this specification, appended claims, and abstract of the disclosure, the term "cover board member(s)" and "spine member" will refer to platelike members of paperboard, cardboard, and the like pasteboard of some consistency as widely employed in the bookbinding art, while by the term coverings reference will be made to a covering for said material cover board and spine members.

In particular coverings applied to the cover board members will be referred to as the coverings, and the covering applied to the spine member as the middle covering. In general, the middle covering is selected with a different color from the color of the side coverings, which are usually of the same color, thereby the resulting binding is of the so-called two-color type.

The most widely used technique for making bindings of the type specified above on a commercial scale provides for the stiff portion thereof to be formed first by joining two cover board members to a corresponding spine member, as by gluing, in an appropriate spaced-apart relationship onto a middle covering.

Thereafter, a respective side covering is applied to (glued on) each of said cover board members.

In actual practice, an apparatus is used for spreading a glue over one face of a middle covering, gluing the cover board and spine members of a binding thereon, to provide in essence a blank (the stiff portion of the binding in question), and stacking the blanks so obtained; in a subsequent step, glue is spread over one face of the side coverings, and these coverings are applied to the cover board members of each blank as progressively picked up from the stack.

Complexity and time-consumption to complete a processing cycle yielding the ultimate half-binding type cover are the most widely recognized disadvantages of the above-discussed technique, which penalize productivity and production costs of such book bindings.

SUMMARY OF THE INVENTION

The problem underlying this invention is that of providing a method of making half-binding type hard covers effective to obviate such prior disadvantages by curtailing the number of the processing steps involved in the completion of a work cycle.

This problem is solved according to the invention by a method which comprises the steps of forming a unitary covering by joining two side coverings to a middle covering, and attaching to said unitary covering, in mutually spaced-apart relationship, a spine member and two cover board members respecitvely over said middle coverings and said side coverings.

In accordance with a characterizing feature of this invention, said middle and side coverings each have a glue applied to one face thereof, side portions of the glue-coated face of the side coverings are pasted to respective side portions of the glueless faces of the middle covering, thus providing the aforesaid unitary covering, which has a glue-coated face on which said spine member and said two cover board members are pasted in mutually spaced-apart relationship.

The advantages and features of a method according to the invention will be more clearly understood from the following description of an embodiment thereof, given by way of example with reference to the accompanying illustrative and non-limitative drawings.

Figure 1:
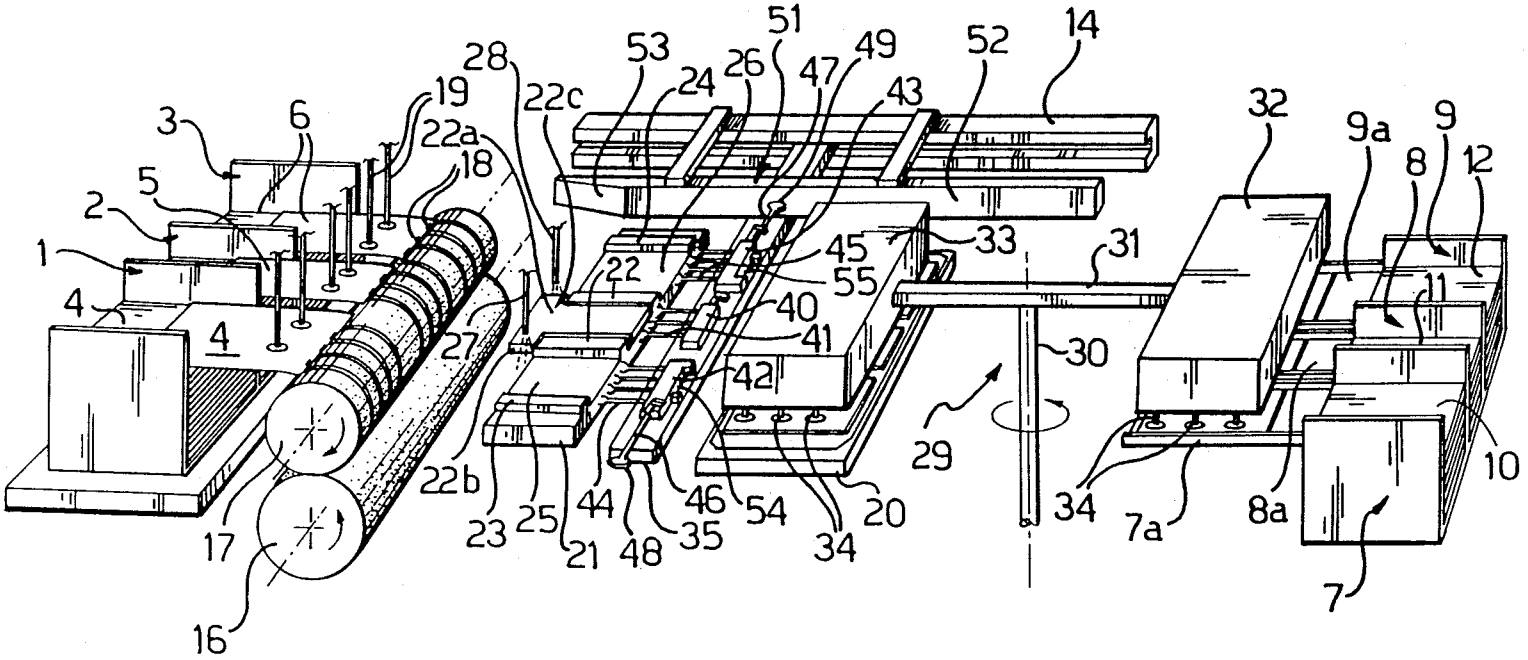
FIGS. 1 to 4 show diagramatically a machine for implementing the inventive method, at successive operating positions thereof.

With reference to the drawing figures, a machine will be next described for implementing the method of this invention.

DESCRIPTION OF THE PREFERRED EMBODIMENTS

This machine will be illustrated and discussed broadly in a very schematic fashion, and discussed in detail will only be those parts thereof, whether known or novel, which are considered to be essential to a proper understanding of this invention.

The machine in question comprises on one side a first set of three loading magazines 1,2 and 3, laid close together in side-by-side relationship, which accommodate side coverings 4,6 and middle coverings 5 orderly arranged in stacks therein.

In detail, the first set of loading magazines 1,2 and 3 has guide walls 2*a* and 2*b* of small thickness which extend respectively between the stacks of side coverings 4 and 6 and the stack of middle coverings 5, as well as guide walls 1*a* and 3*a* which extend respectively alongside the stacks of side coverings 4 and 6.

A second set of three loading magazines 7,8 and 9, arranged side-by-side closely together and accommodating cover board members 10,12 and spine members 11 in orderly stacks therein, is located on the other side of the machine. Said loading magazines 7,8 and 9 are each provided with a respective horizontal shelf 7*a*, 8*a* and 9*a* extending toward the first set of loading magazines and being adapted to receive a respective cover board member or spine member.

A work deck 20 is supported stationary at an intermediate position between the first and second sets of loading magazines, 1,2,3 and 7,8,9, respectively.

Two straight sectional members 14,15, having a C-like cross-section configuration and being an integral part of the load bearing structure (not shown) of the machine according to the invention, extend at the same height level along two opposed sides thereof.

The sectional members 14,15 and the aforesaid sets of loading magazines define substantially the periphery of the machine being discussed.

Located in front of the first set of loading magazines 1,2 and 3 is a glue coating station which comprises a pair of mutually cooperating rolls 16 and 17. The roll 16 is a roll arranged to spread an appropriate adhesive material, and will be more briefly referred to hereinafter as the pasting roll. The roll 17 is an entraining roll for coverings 4,5 and 6, and is conventionally provided, for this purpose, with a plurality of picker means 18 (such as small grippers) distributed along a generatrix lin thereof and being controlled in just as conventional a manner and not shown.

The reference numeral 19 designates schematically means, such as suction cup type of picker members, operated pneumatically to pick up coverings 4,5 and 6 one by one from respective ones of the loading magazines 1,2 and 3, and feed them to the tablet entraining roll 17.

Between the work deck 20 and roll pair 16,17, there is supported a table 21 which extends parallel to said rolls at the same level as the work deck 20.

A flat middle portion 22 of said table 21 is raised and extends toward the roll pair 16,17 with a shelf-like section 22*a*. Indicated at 22*b* and 22*c* are side edges of the shelf-like section 22*a*.

The reference numerals 23 and 24 designate two parallel ledges formed on the table 21 on either side of the flat middle portion 22 at preset distances therefrom.

Between this flat portion 22 and the ledges 23 and 24, there are defined two seats 25,26 for accommodating the side coverings 4,6, as explained hereinafter.

It should be noted that the seats 25 and 26 have a width dimension, as measured along a parallel direction to the axes of the rolls 16 and 17 and designated "l", which is substantially equal to the width dimension A of the side tablets, thereby the side coverings are movable along the seats 25 and 26 in a guided manner.

The raised portion 22 has a width dimension, as measured along that same direction and indicated at "s", which is equal to the distance which should seperate the side coverings when installed in the binding.

The shelf-like section 22*a* jutting out of the middle portion 22 has instead a width dimension, as measured along that same direction and designated "p", which is slightly smaller than the width "s", hereby the edges 22*b* and 22*c* of the shelf-like section 22*a* are slightly recessed by a distance "q" from the raised portion 22. Thus, the glue-coated side coverings are prevented from rubbing against said edges 22*b* and 22*c* while moving past.

Two blower nozzles 27,28, supplied with pressurized air from a source not shown, are supported vertically above in the proximities of the opposed edges 22*b* and 22*c* of the shelf-like section 22*a* of the flat middle portion 22 of the table 21.

Located between the work deck 20 and the second set of loading magazines 7,8 and 9 is a transfer applicator device, substantially of a conventional carousel variety, indicated at 29. In essence, that device comprises an upright 30, displaceable in the vertical direction and pivotable about its vertical axis; a horizontal arm 21, attached to said upright 30 to a T-like configuration; two heads 32,33, at the ends of said arm 31 and provided with a number of suction cup means 34 and respective actuator members (not shown) for said suction cup means, to pick up two cover board members 10,12 and a spine member 11 at one time from the shelves 7*a*,8*a* and 9*a* of the second set of loading magazines and transfer them onto the work deck 20 in a manner and for a purpose to be explained hereinafter.

Figure 2:
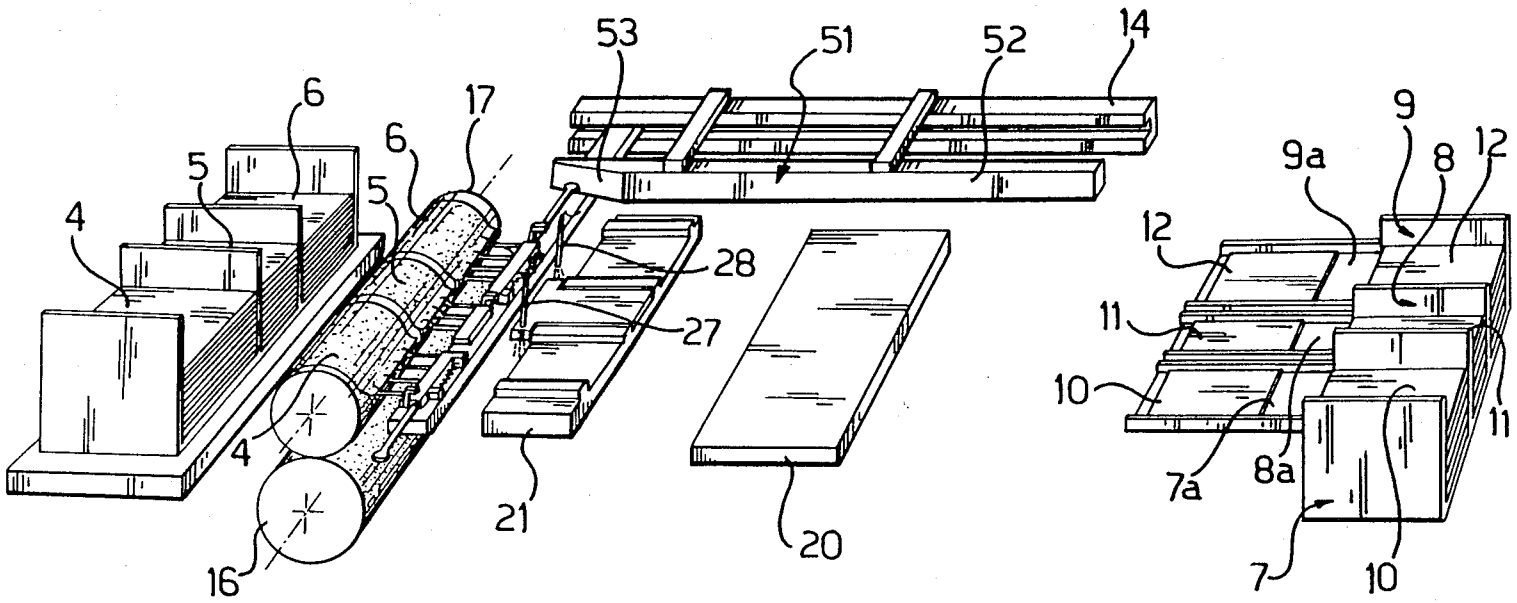
Figure 3:
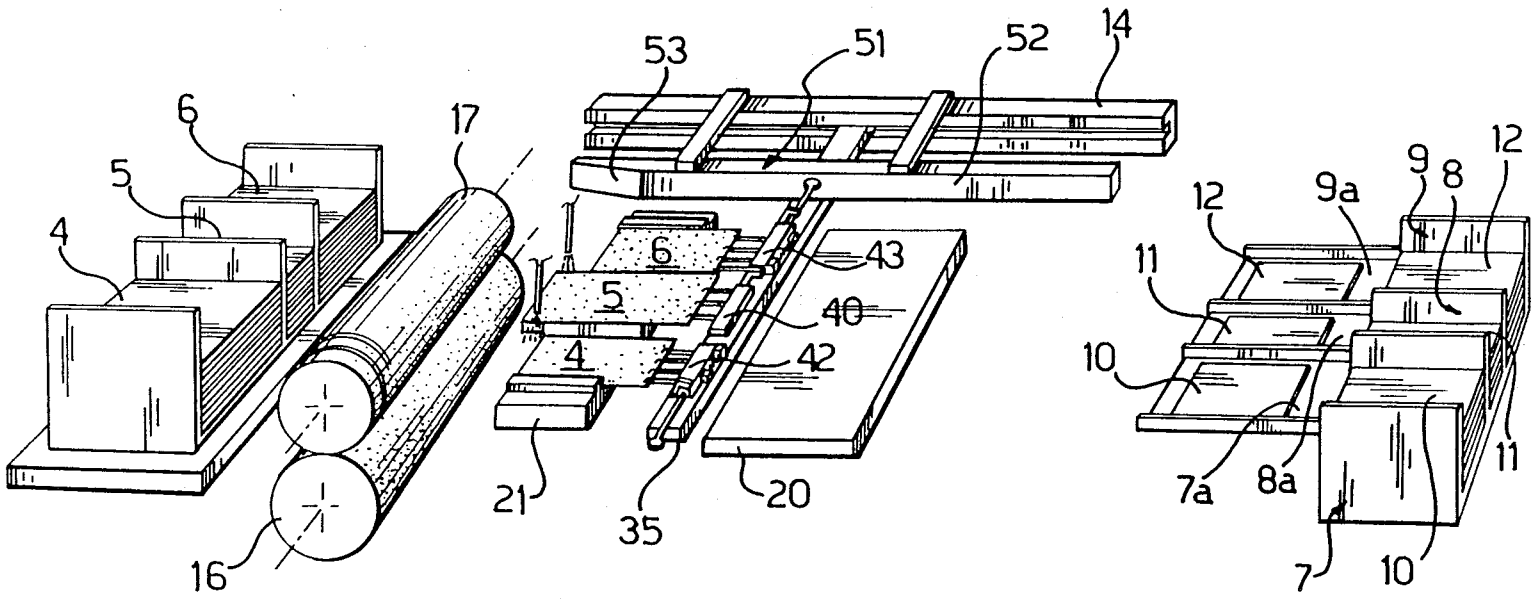
Figure 4:
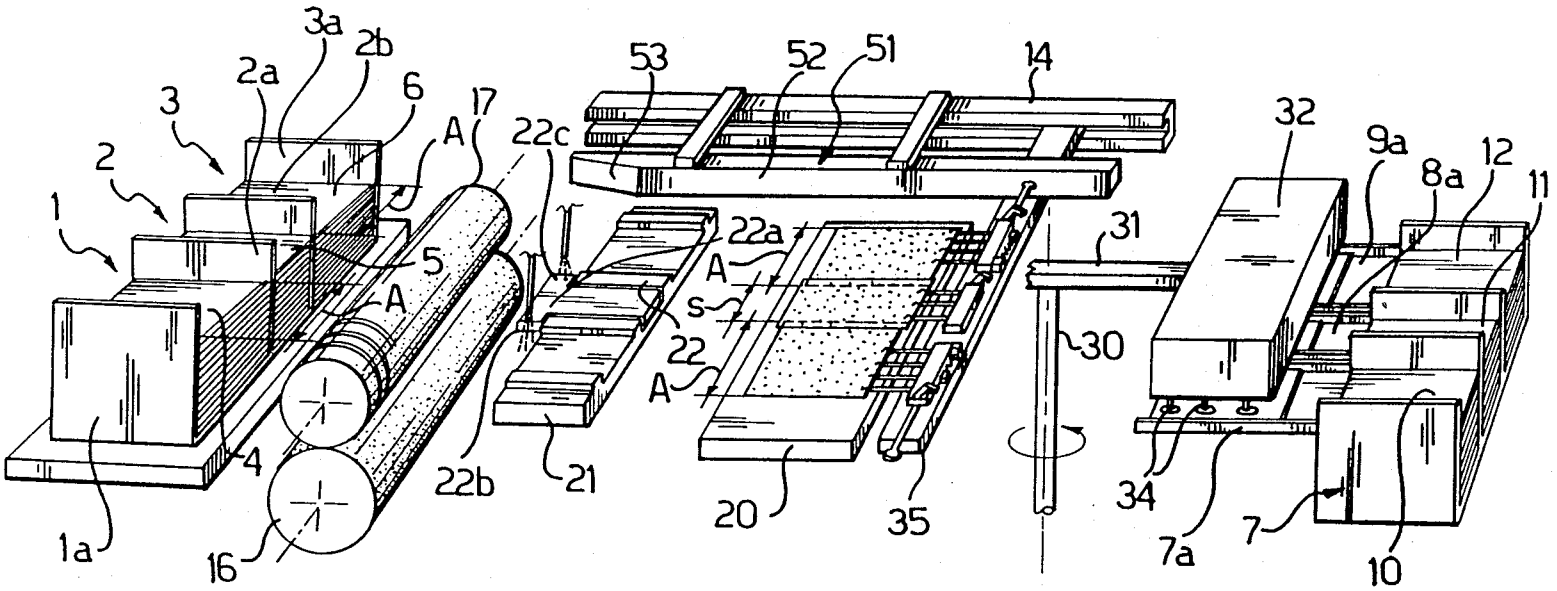
Figure 5:
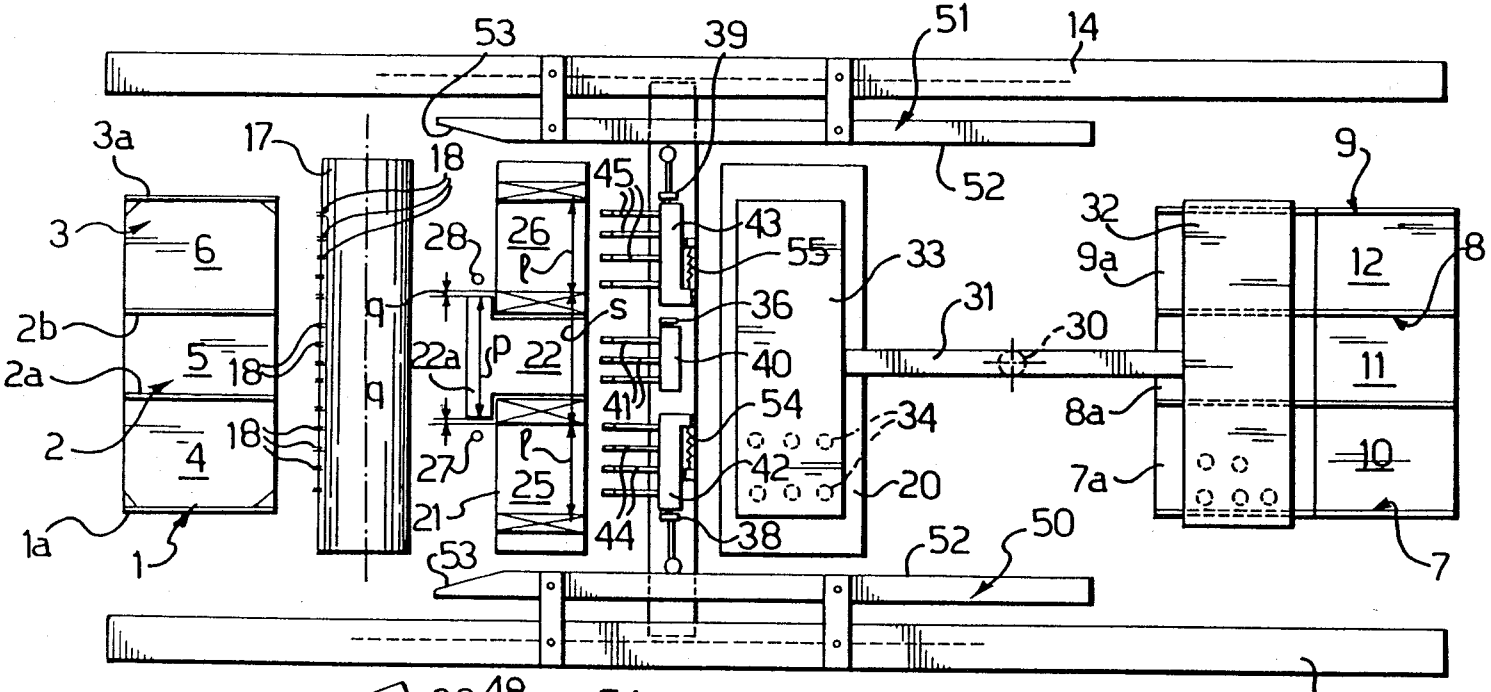
FIG. 5 is a reduced scale plan view showing diagramatically the same machine as in the preceding figures.
Figure 6:
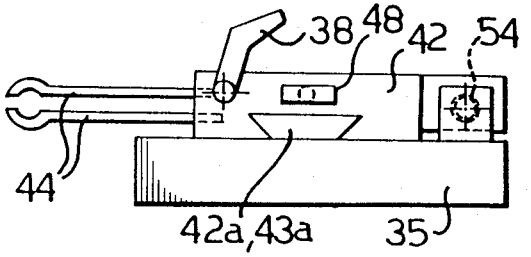
FIG. 6 is a cross-sectional detail view of the machine shown in FIG. 5.

A carriage 35, configured and constructed substantially as a flat beam, extends parallel to the rolls 16,17 and has opposed ends which are guided in the C-section members 14,15 of the machine load-bearing structure. The carriage 35 is movable from a position close to the coverings entraining roll 17 (FIG. 2) to a position included between the work deck 20 and the second set of loading magazines 7,8 and 9 (FIG. 4). The linear displacement movements of the carriage 35 are imparted by conventional means and devices, not shown, such as pairs of drive chains trained around and driven by sprocket wheels journalled to the sectional members 14,15 or rack-and-pinion and the like devices.

It should be noted that the carriage 35 travels above the table 21 and work deck 20, barely in touch with them.

Secured at a middle location on the carriage 35 is a prismatic body 40 carrying a set of grippers 41 which extend toward the roll pair 16,17 and are operative to pick up and transfer the middle coverings 5 one by one, as explained hereinafter.

Laterally of the body 10 and aligned thereto, there are formed lengthwise on the carriage 35 two slideways 42*a*,43*a*, on which two slides 42,43 are mounted movingly. These slides 42,43 carry respective sets of grippers 44,45 extending toward the rolls 16 and 17 and being operative to pick up and transfer, one by one, the side coverings 4 and 6, respectively, in a manner to be explained hereinafter.

A control means, known per se, is provided to control the grippers 41 carried on the prismatic body 40 to open and close. This means comprises arms mounted on the machine load-bearing framework and not shown in the drawings, which act on a small lever 36 associated with the grippers 41 and being movable with a snap action alternately between an open gripper position and a closed gripper position.

A like control means is provided to control the grippers 44 and 45 carried on the slides 42 and 43 to open and close, and comprising arms acting on small levers 38 and 39 associated with the grippers 44 and 45, respectively.

Each of said slides 42,43 carries, cantilever mounted thereon, a respective rod-like arm 46,47 which extends in the direction of movement of the slides and outwards of the carriage 35. Mounted on the free ends of said rod-like arms 46,47 are respective feeler member 48,49 contacting cams 50,51 which are carried cantilever-fashion on the sectional members 14,15 of the machine load-bearing structure. Each of said cams 50,51 includes a straight section 52 of substantial length which extends parallel to the direction of movement of the carriage 35, and a shorter sloping section 53 arranged to diverge toward the roll pair 16,17. The corner edge separating the sections 52, 53 is aligned to the side of the table 21 facing said roll pair 16,17.

Spring loaded means, indicated at 54 and 55 and being positioned between attachment blocks on carriage 35 and the slides 42 and 43 are effective to keep the feeler members 48,49 in constant contact with the cams 50 and 51, respectively.

Figure 7:
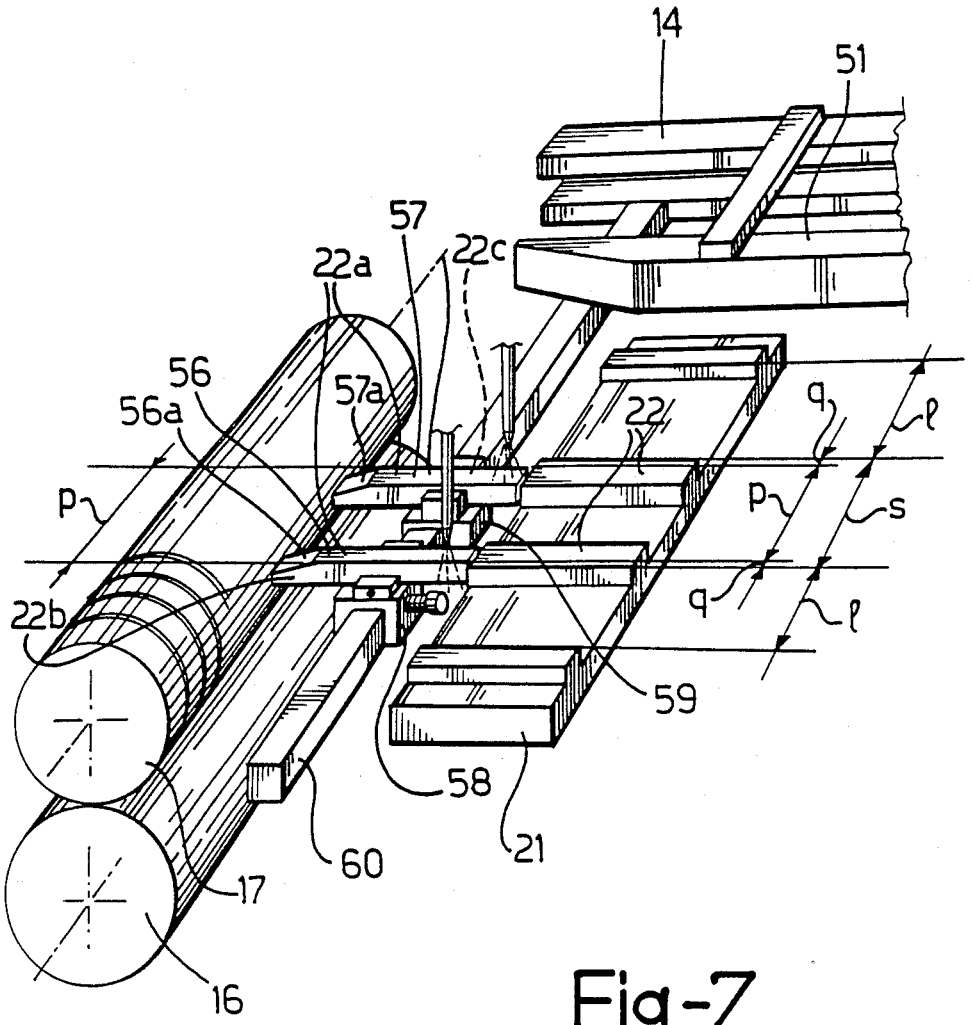
FIG. 7 is a perspective view of a detail of a modified embodiment of the machine according to the invention.

With reference to FIG. 7, a modified embodiment of the inventive machine will be next described. In the Figure, elements having the same construction and/or operating in the same way as those described hereinabove are designated with like reference characters. In this modified embodiment, the shelf-like section 22*a* of the raised flat portion 22 is comprised of two strips 56 and 57 forming respectively the edges 22*b* and 22*c* of the shelf-like section 22*b*.

The strips 56 and 57 have one end confronting the glue application station 16,17 which is formed with a lead-in incline 56*a* and 57*a*, the opposed end facing the raised flat portion 22.

The strips 56 and 57 are supported on respective small blocks 58 and 59 which are slidable in an adjustable manner along a beam 60 extending perpendicularly to the direction of movement of the carriage 20 and being fastened, at its opposed ends, to the straight sectional member 14 and 15, respectively.

By virtue of the positions of the strips being adjustable in a perpendicular direction to the carriage direction of movement, the distance "q" may be adjusted to be the least possible.

It should be noted that the strips 56 and 57 are supported on their respective blocks 58 and 59 in an adjustable sliding manner along a parallel direction to the carriage direction of movement.

Thanks to this adjustable feature, the strips can be positioned to accommodate the height dimensions of the binding tablets being produced each time.

The method of this invention will be next described as implemented on the machine just described with reference to the accompanying drawings.

On actuating the suction cup picker members 19, there are picked up from the first set of loading magazines 1,2,3 a side covering 4, side covering 6, and middle covering 5, which are taken to the covering entraining roll 17 where the picker means 18 are operated to grip on and hold securely said coverings by their front edges (FIG. 1).

Thereafter (FIG. 2), the above-mentioned coverings are entrained by said roll 17 to contact the pasting roll 16 (FIG. 2), thereby on leaving said rolls 16,17 each covering will have a respective layer of glue applied to one face (specifically, its upward face).

On completion of this first step, the picker means (grippers 18) of the tablet entraining roll 17 are all released simultaneously, and the edges of the coverings 4,5 and 6, thus released, are gripped at once in the gripper plurality on the carriage 35, which has been positioned in the meantime in front of the roll 17. It should be noted that with the carriage 35 in this position (FIG. 2), the feeler members 48,49 on the slides 42,43 carried thereon will be in contact with the outward diverging inclined profiles 53 of the cams 50,51. Consequently, the prevailing action of the springs 54,55 on said slides is such as to hold the slides at their positions of maximum distance apart, thus also moving the side coverings 4 and 6 away from the middle covering 5.

During the following step of the inventive method, the side coverings 4 and 6 are joined to the middle covering 5 to form a unitary covering. For this purpose the carriage 35 would be moved toward and past the table 21. During this movement, the feeler members 48,49 of the slides 42 and 43 will be moving along the inclined sections 53 of the cams 50 and 51, thereby said slides 42,43 will approach the middle body 40 against the bias of the springs 54,55. This approaching movement is stopped on the feeler members 48,49 reaching the straight sections 52 of the cams 50,51, that is on the front edges of the covering locating themselves at the shelf-like section 22*a* of the middle portion of the table 21, preparatory to entering the seats 25 and 26.

In this condition, the blower nozzles 27,28 will be acting on the longitudinal edges of the side coverings 4 and 6, thereby as the carriage 35 keeps running toward the work deck 20, with the middle covering 5 lying on the raised middle portion 22 of the table 21, the side coverings 4 and 6, and more precisely, the longitudinal edge portions thereof, will travel along the recessed seats 25 and 26 in said table.

Thus, on leaving the table, the side coverings 4 and 6 will have edge portions (coated with glue) underlying respective edge portions (uncoated with glue) of the middle covering 5. As said coverings 4,5 and 6 are laid by the carriage 35 onto the work deck 20, the net result is a covering of unitary construction which has its upward face coated with a layer of glue throughout.

To this unitary covering there are applied and attached two cover board members 10,12 and a spine member 11 by suitable operation of the transfer applicator device 29. Of course, said cover board members 10,12 and spine member 11 would be positioned at the side coverings 4 and 6 and the middle covering 5 which make up said covering of unitary construction.

The resulting half-binding type hard cover is thus ready to undergo further processing.

It may be appreciated from the foregoing that the method of this invention, in obviating all the disadvantages of the prior art, affords increased output rare of half-binding type hard covers without any loss in the accuracy, and hence the aesthetic appeal, of the ultimate produce, while significantly lowering their production costs.

I claim:

1. A method of making hard cover of the half-binding type comprising two cover board members and a spine member held together by a middle covering, and two more coverings covering said cover board members characterized in that it comprises the steps of forming a unitary covering by superimposing two side coverings in overlapping relation to respective lateral edges of a middle covering, and then securing to said unitary covering, in mutually spaced apart relationship, a spine member and two cover board members respectively at said middle covering and said side coverings.

2. A method according to claim 1, characterized in that said middle covering and said side coverings are each coated with glue on one face thereof, side portions of the glue-coated faces of said side coverings are attached to respective side portions of the glue-less face of said middle covering to form said unitary covering, the latter unitary covering having a glue-coated face whereto there are pasted, in mutually spaced apart relationship, said spine member and said two cover board members.

3. A method according to claim 2, characterized in that the side coverings and middle covering are coated with glue by a single operation.

4. A method according to claim 3, characterized in that the side coverings are attached to said middle covering by a single operation.

5. A method according to claim 1, characterized in that said spine member and said cover board members are attached to said unitary covering by a single operation.

6. A machine for making half-binding type hard covers, characterized in that it comprises a first set of loading magazines to respectively accommodate stacks of side and middle coverings, a second set of loading magazines to respectively accommodate stacks of cover board members and spine members, a work deck carried between said first and second sets of loading magazines, a transfer applicator device for picking up and transferring said cover board and spine members from respective ones of said loading magazines onto said work deck, a glue application station in the proximity of said first set of loading magazines, a table carried between said work deck and said glue application station, a raised flat portion formed in the middle region of said table to support a middle covering, said middle portion having a section which extends shelf-like toward said glue application station, with opposedly located edges, recessed seats formed in said table on either side of said raised portion to support respective ones of said side coverings, at least two blower nozzles aimed vertically to act on either side of said shelf-like section, a carriage guided for movement between said first and second sets of loading magazines at a position overlying said work deck and said table, a body attached centrally to said carriage and provided with respective picker means operative to pick up a middle covering, two slides guided for movement on said carriage along a perpendicular direction to the carriage direction of movement and provided with respective pluralities of picker means operative to pick up corresponding ones of said side coverings, and means for shifting said slides away from and toward said centrally located body.

7. A machine according to claim 6, characterized in that said first set of loading magazines for the respective stacks of side and middle coverings includes two guide walls of small thickness extending respectively between said stacks of side coverings and stack of middle coverings.

8. A machine according to claim 6, characterized in that the opposed edges of the shelf-like section of the flat raised portion are comprised of respective strips supported on respective small blocks mounted in an adjustable sliding manner along a beam lying in a perpendicular direction to the direction of movement of the carriage.

9. A machine according to claim 8, characterized in that the strips are supported on the blocks in an adjustable sliding manner along a direction parallel to the carriage direction of movement.

* * * * *

UNITED STATES PATENT AND TRADEMARK OFFICE

CERTIFICATE OF CORRECTION

PATENT NO. : 4,863,331

DATED : September 5, 1989

INVENTOR(S) : Alessandro Torti

It is certified that error appears in the above-identified patent and that said Letters Patent is hereby corrected as shown below:

In column 6, line 29, delete "cover" and insert therefor --covers--.

Signed and Sealed this

Second Day of October, 1990

*Attest:*

HARRY F. MANBECK, JR.

*Attesting Officer*

*Commissioner of Patents and Trademarks*